US008349789B2

(12) United States Patent
Lant

(10) Patent No.: US 8,349,789 B2
(45) **Date of Patent: *Jan. 8, 2013**

(54) LAUNDRY COMPOSITION

(75) Inventor: Neil Joseph Lant, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/480,000

(22) Filed: Jun. 8, 2009

(65) Prior Publication Data

US 2009/0318326 A1 Dec. 24, 2009

(30) Foreign Application Priority Data

Jun. 20, 2008 (EP) ..... 08158707

(51) Int. Cl.
*C11D 3/22* (2006.01)

(52) U.S. Cl. ..... 510/473; 510/320; 510/276; 510/470; 510/471; 510/321; 510/393; 424/70.13; 106/31.36; 8/137; 527/302; 527/300; 435/209; 435/263; 435/264

(58) Field of Classification Search ..... 435/209, 435/263, 264; 510/320, 321, 393, 276, 470, 510/473, 471; 424/70.13; 106/31.36; 8/137; 527/302, 300

See application file for complete search history.

(56) References Cited

U.S. PATENT DOCUMENTS

| | | | | |
|---|---|---|---|---|
| 6,855,531 | B2 * | 2/2005 | Shulein et al. | 435/209 |
| 7,947,643 | B2 * | 5/2011 | Lant | 510/470 |
| 2004/0097394 | A1 * | 5/2004 | Burrows et al. | 510/421 |
| 2011/0034365 | A1 * | 2/2011 | Lant | 510/298 |

FOREIGN PATENT DOCUMENTS

| | | |
|---|---|---|
| EP | 08158707 | 6/2008 |
| WO | WO 2006/088953 A | 8/2006 |

OTHER PUBLICATIONS

Regiani et al. (Mol.Cryst and Liq Cryst, 2000,vol. 353 pp. 181-189).*
"The Influence of the Solvent System Used During Manufacture of CMC"—Stigsson et al., Cellulose, vol. 13, 2006—Abstract.

* cited by examiner

*Primary Examiner* — Vasu Jagannathan
*Assistant Examiner* — Mark Kaucher
(74) *Attorney, Agent, or Firm* — Julie A. McConihay; Leonard W. Lewis; Steven W. Miller

(57) ABSTRACT

Laundry treatment composition comprising a substituted cellulose having a degree of substitution, DS, of from 0.01 to 0.99 and a specific degree of blockiness, DB, such that either DS+DB is of at least 1 or DB+2DS−DS$^2$ is of at least 1.20, and a laundry adjunct ingredient.

8 Claims, 1 Drawing Sheet

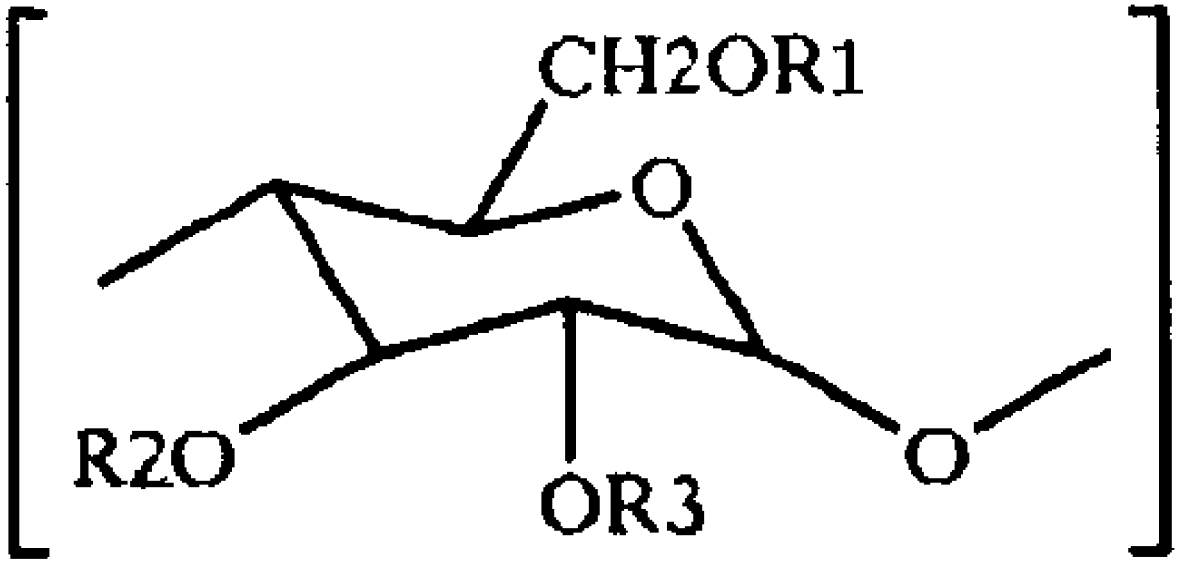
CH2OR1
O
R2O
OR3
O

LAUNDRY COMPOSITION

FIELD OF THE INVENTION

The present invention relates to laundry treatment composition comprising substituted cellulose having a specific degree of substitution and a specific degree of blockiness. The laundry treatment compositions of the present invention are in particular suitable for use in laundry detergent compositions or other fabric-treatment compositions.

BACKGROUND OF THE INVENTION

When articles such as clothes and other textiles are washed, cleaning performances may be affected by the redeposition of the soil onto the fabrics. The redeposition of the soil may manifest itself as a general greying of the textiles. Already in the 1930's it was discovered that a substituted polysaccharide, carboxymethylcellulose (CMC), was particularly suitable as an antiredeposition agent and could be used in the washing water to alleviate this redeposition problem.

Although there are nowadays many types of commercial substituted celluloses, the substituted celluloses used in the laundry compositions have remained substantially the same for the past decades.

The Inventors have now surprisingly found that a specific class of substituted celluloses having a specific degree of substitution (DS) and degree of blockiness (DB) had unexpected better antiredeposition performance when compared with the substituted celluloses usually present in the commercial detergent composition.

SUMMARY OF THE INVENTION

In one embodiment of the present invention, the invention concerns a composition being a laundry treatment composition or component thereof, comprising:

a substituted cellulose having a degree of substitution, DS, of from 0.01 to 0.99 and a degree of blockiness, DB, such that either DS+DB is of at least 1.00 or $DB+2DS-DS^2$ is of at least 1.20 and a laundry adjunct ingredient.

The laundry treatment composition may be a detergent composition or a fabric care composition.

The laundry treatment composition may have a better antiredeposition effect than conventional laundry composition and/or may comprise a lower level of substituted cellulose while still providing a satisfying antiredeposition effect.

According to a further embodiment, the present invention concerns the use of a composition according to the invention as a laundry treatment composition.

The invention also concerns the use of a substituted cellulose having a degree of substitution, DS, of from 0.01 to 0.99 and a degree of blockiness, DB, such that either DS+DB is of at least 1 or $DB+2DS-DS^2$ is of at least 1.20, to increase whiteness of a washed fabric and/or to improve the tensile strength of cotton fibre.

According to a further embodiment, the invention concerns a laundry composition comprising a substituted cellulose having a degree of substitution, DS, of from 0.01 to 0.99 obtained by a process comprising one step to induce blockiness of the substituents.

According to a further embodiment, the invention concerns a laundry composition comprising a substituted cellulose having a degree of substitution, DS, of from 0.01 to 0.99 and comprising at least 5%, or 10%, or 15%, or even 20% of its substituted sugar units which are polysubstituted.

BRIEF DESCRIPTION OF THE DRAWING

FIG. 1 is a β-1,4 linkage.

DETAILED DESCRIPTION OF THE INVENTION

Substituted Cellulose

As used herein, the term "celluloses" includes natural celluloses and synthetic celluloses. Celluloses can be extracted from plants or produced by microorganisms.

The laundry treatment composition of the invention comprises a substituted cellulose. The substituted cellulose comprises a cellulose backbone consisting essentially of glucose units.

The degree of substitution, DS, of the substituted cellulose is of from 0.01 to 0.99. The sum of the degree of substitution and the degree of blockiness, DS+DB, of the substituted cellulose may be of at least 1. The $DB+2DS-DS^2$ of the substituted cellulose may be of at least 1.10.

The substituted cellulose may be substituted with identical or different substituents.

The composition of the invention may comprise at least 0.001%, or even at least 0.01% by weight of substituted cellulose. In particular the composition may comprise from 0.03% to 20%, especially from 0.1 to 10, or even from 0.3 to 3, for example from 1 to 1.5% by weight of substituted cellulose.

The substituted cellulose comprises unsubstituted glucose units. Unsubstituted glucose units are glucose units having all their hydroxyl groups remaining unsubstituted. In the substituted cellulose, the weight ratio of unsubstituted glucose units the total number of glucose units may be comprised between 0.01 to 0.99.

The substituted cellulose comprises substituted glucose units. Substituted glucose units are glucose units having at least one of their hydroxyl groups being substituted. In the substituted cellulose, the weight ratio of substituted glucose units the total number of glucose units may be comprised between 0.01 to 0.99.

Cellulose Backbone

The cellulose backbone is substantially linear. By substantially linear it is to be understood that at least 97%, for example at least 99% (by weight), or all the glucose units of the polymer are in the main chain of the cellulose backbone.

Celluloses have a substantially β-1,4 linked backbone. By substantially β-1,4 linked backbone it is to be understood that at least 97%, for example at least 99% (by weight), or all the glucose units of the polymer are bounded with β-1,4 linkage. When present, the remaining glucose units of the cellulose backbone may be bounded in a variety of ways, such as α- or β- and 1-2, 1-3, 1-4, 1-6 or 2-3 linkages and mixtures thereof.

The cellulose backbone consists essentially of glucose units. Consisting essentially of glucose units should be understood as comprising more than 95% or 97%, for example more than 99%, or even comprising 100% by weight of glucose units.

A monomer of cellulose which is joined to other cellulose monomers through β-1,4 linkages as shown in FIG. 1.

R1, R2 and R3 show the positions of the hydrogen atoms in the cellulose monomer available for substitution by the substituent.

Substituent

The substituted cellulose comprises at least one glucose unit of its backbone which is substituted. Suitable substituents may be selected from the group consisting of branched, linear or cyclic, substituted or not substituted, saturated or unsaturated alkyl, amine (primary, secondary, tertiary), ammonium salt, amide, urethane, alcohol, carboxylic acid, tosylate, sulfonate, sulfate, nitrate, phosphate, silicone, and mixtures thereof.

The substitution may take place on any hydroxyl group of the glucose unit. For example, in the case of a glucose unit linked by β-1,4 linkage, as shown in FIGURE (I), the substitution can take place in position 2, 3 and/or 6 of the glucose unit. The hydroxyl group —OH of the glucose may be substituted with a —O—R or —O—C(═O)—R group.

R may be an anionic, a cationic or a non-ionic group. R may be selected from the group consisting of: $R_1$, $N(R_2)(R_3)$, silicone moiety, $SO_3^-$, $PO_3^-$, with $R_2$ and $R_3$ being independently of each other an hydrogen atom or a $C_{1-6}$ alkyl and $R_1$ being a linear or branched, typically linear, saturated or unsaturated, typically saturated, substituted or unsubstituted, typically substituted, cyclic or acyclic, typically acyclic, aliphatic or aromatic, typically aliphatic, $C_1$-$C_{300}$, typically $C_1$-$C_{30}$, $C_1$-$C_{12}$, or $C_1$-$C_6$ hydrocarbon radical which hydrocarbon backbone may be interrupted by a heteroatom chosen form O, S, N and P. $R_1$ may be substituted by one or more radical selected from amino (primary, secondary, or tertiary), amido, —OH, —CO—$OR_4$, —$SO_3^-$, $R_4$, —CN, and —CO—, where $R_4$ represents a hydrogen atom or an alkali metal, preferably a sodium or potassium, ion.

R may be one following anionic groups, in its acid or salt form, preferably sodium (given here) or potassium salt form:

-T-$CO_2$Na
-T-$SO_3$Na
—$PO_3$Na
—$SO_3$Na

Wherein T is a $C_{1-6}$ alkyl, more preferably $C_{1-4}$ alkyl.

The R substituent may be the following cationic group:

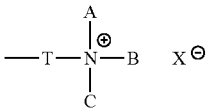

Wherein T is a $C_{1-6}$ alkyl, or $CH_2CH(OH)CH_2$, each A, B, and C is $C_{1-6}$ alkyl or hydroxy-$C_{1-6}$ alkyl, X is a counterion such as halide or tosylate.

R may be one following non-ionic groups:

-A
-T-OH
-T-CN
—C(═O)A
—C(═O)$NH_2$
—C(═O)NHA
—C(═O)N(A)B
—C(═O)OA
—$(CH_2CH_2CH_2O)_nZ$
—$(CH_2CH_2O)_nZ$
—$(CH_2CH(CH_3)O)_nZ$
—$(CH_2O)_nZ$

Wherein: A and B are $C_{1-30}$ alkyl; T is $C_{1-6}$ alkyl; n=1 to 100; Z is H or $C_{1-6}$ alkyl.

R may be a hydroxyalkyl, carboxyalkyl, or sulfoalkyl group or a salt thereof. R may represent a hydroxy $C_{1-4}$ alkyl, such as a 5-hydroxymethyl group, a carboxy $C_{1-6}$ alkyl, such as a carboxy $C_{1-4}$ alkyl group, or a sulfo-$C_{2-4}$ alkyl, such as a sulfoethyl group, a $C_1$-$C_{30}$ alkanoyl or a salt (for example a sodium salt) thereof.

In exemplary embodiments, —O—R represents a group selected from —O—$CH_2OH$, —O—$CH_2CH_2SO_3H$, —O—$CH_2$—$CO_2H$, —O—CO—$CH_2CH_2CO_2H$, and salt (for example a sodium salt) thereof. Preferably, the substituent is a carboxymethyl group.

The substitutent may be a benefit group, suitable benefit groups include perfumes, perfume particles, enzymes, fluorescent brighteners, oil repellent agents, water repellent agents, soil release agents, soil repellent agents, dyes including fabric renewing dyes, hueing dyes, dye intermediates, dye fixatives, lubricants, fabric softeners, photofading inhibitors, antiwrinkle/ironing agents, shape retention agents, UV absorbers, sunscreens, antioxidants, crease resistant agents, antimicrobial agents, skin benefit agents, anti-fungal agents, insect repellents, photobleaches, photoinitiators, sensates, enzyme inhibitors, bleach catalysts, odor neutralizing agents, pheromones, and mixtures thereof.

Degree of Substitution (DS).

The substituted cellulose of the invention has a DS of from 0.01 to 0.99.

As those of skill in the art of cellulosic polymers chemistry, recognize, the term "degree of substitution" (or DS) refers to average degree of substitution of the functional groups on the cellulose units of the cellulose backbone. Thus, as each of the glucose unit of the cellulose backbone comprises three hydroxyl groups, the maximum degree of substitution of the substituted cellulose is 3. DS values do not generally relate to the uniformity of substitution of chemical groups along the cellulose backbone and are not related to the molecular weight of the cellulose backbone. The degree of substitution of the substituted cellulose may be of at least 0.02, or 0.05, in particular of at least 0.10, or 0.20, or even 0.30. Typically, the degree of substitution of the cellulose backbone is from 0.50 to 0.95, in particular from 0.55 to 0.90, or from 0.60 to 0.85, or even from 0.70 to 0.80.

The methods to measure the DS may vary as a function of the substituent. The skilled person knows or may determine how to measure the degree of substitution of a given substituted cellulose. By way of example, the method to measure the DS of a carboxymethylcellulose is disclosed thereafter.

Test Method 1: Evaluation of CMC polymer Degree of Substitution (DS)

The DS was determined by igniting CMC to ash at high temperature (650° C.) for 45 minutes in order to remove all the organic material. The remaining inorganic ashes were dissolved in distilled water and methyl red added. The sample was titrated with 0.1M hydrochloric acid until the solution turned pink. The DS was calculated from the amount of titrated acid (b ml) and the amount of CMC (G g) using the formula below.

$$DS=0.162*\{(0.1*b/G)/[1-(0.08*0.1*(b/G))]\}$$

Alternatively, the DS of a substituted cellulose may be measured by conductimetry or $^{13}C$ NMR. Experimental protocols for both approaches are given in D. Capitani et al, Carbohydrate Polymers, 2000, v 42, pp 283-286.

Degree of Blockiness (DB)

The substituted cellulose of the invention have a DB such as either DB+DS is at least of 1 or $DB+2DS-DS^2$ is of at least 1.20.

As those of skill in the art of cellulosic polymers chemistry recognise, the term "degree of blockiness" (DB) refers to the extent to which substituted (or unsubstituted) glucose units are clustered on the cellulose backbone. Substituted celluloses having a lower DB may be characterized as having a more even distribution of the unsubstituted glucose units along the cellulose backbone. Substituted celluloses having a higher DB may be characterized as having more clustering of the unsubstituted glucose units along the cellulose backbone.

More specifically, in a substituted cellulose comprising substituted and unsubstituted glucose units, the DB of the substituted cellulose is equal to B/(A+B), with A referring to the number of unsubstituted glucose units directly linked to at least one substituted glucose units, and B refers the number of unsubstituted glucose units not directly linked to a substituted glucose unit (i.e. only directly linked to unsubstituted glucose units).

Typically, the substituted cellulose has a DB of at least 0.35, or even from 0.40 to 0.90, from 0.45 to 0.80, or even from 0.50 to 0.70.

The substituted cellulose may have a DB+DS of at least 1. Typically the substituted cellulose has a DB+DS of from 1.05 to 2.00, or from 1.10 to 1.80, or from 1.15 to 1.60, or from 1.20 to 1.50, or even from 1.25 to 1.40.

The substituted cellulose having a DS comprised between 0.01 and 0.20 or between 0.80 to 0.99 may have a DB+DS of at least 1, typically of from 1.05 to 2.00, or from 1.10 to 1.80, or from 1.15 to 1.60, or from 1.20 to 1.50, or even from 1.25 to 1.40.

The substituted cellulose having a DS comprised between 0.20 and 0.80 may have a DB+DS of at least 0.85, Typically of from 0.90 to 1.80, or from 1.00 to 1.60, or from 1.10 to 1.50, or from 1.20 to 1.40.

The substituted cellulose may have a $DB+2DS-DS^2$ of at least 1.20. Typically the substituted cellulose has a $DB+2DS-DS^2$ of from 1.22 to 2.00, or from 1.24 to 1.90, or from 1.27 to 1.80, or from 1.30 to 1.70, or even from 1.35 to 1.60.

The substituted cellulose, having a DS comprised between 0.01 and 0.20, may have a $DB+2DS-DS^2$ of from 1.02 or 1.05 to 1.20.

The substituted cellulose, having a DS comprised between 0.20 and 0.40, may have a $DB+2DS-DS^2$ of from 1.05 or 1.10 to 1.40.

The substituted cellulose, having a DS comprised between 0.40 and 1.00 or between 0.60 and 1.00 or between 0.80 and 1.00, may have a $DB+2DS-DS^2$ of from 1.10 to 2.00, or from 1.20 to 1.90, or from 1.25 to 1.80, or from 1.20 to 1.70, or even from 1.35 to 1.60.

The methods to measure the DB may vary as a function of the substituent. The skilled person knows or may determine how to measure the degree of substitution of a given substituted cellulose. By way of example, a method to measure the DB of a substituted cellulose is disclosed thereafter.

Test Method 2: Evaluation of Substituted Cellulose Degree of Blockiness (DB)

In the case of a substituted cellulose, the DB may correspond to the amount (A) of non-substituted glucose units released after a specific enzymatic hydrolysis with the commercial endoglucanase enzyme (Econase CE, AB Enzymes, Darmstadt, Germany) divided by the total amount of non-substituted glucose units released after acid hydrolysis (A+B). The enzymatic activity is specific to non-substituted glucose units in the polymer chain that are directly bounded to another non-substituted glucose unit. Further explanation of substituted cellulose blockiness and measurement is provided in detail in V. Stigsson et al., Cellulose, 2006, 13, pp 705-712.

The enzymatic degradation is performed using the enzyme (Econase CE) in a buffer at pH 4.8 at 50° C. for 3 days. To 25 ml of substituted cellulose sample, 250 μL of enzyme is used. The degradation is stopped by heating the samples to 90° C. and keeping them hot for 15 minutes. The acid hydrolysis for both substitution pattern and blockiness is carried out in perchloric acid (15 min in 70% $HClO_4$ at room temperature and 3 hours in 6.4% $HClO_4$ at 120° C.). The samples are analysed using Anion Exchange Chromatography with Pulsed Amperiometric Detection (PAD detector: BioLC50 (Dionex, Sunnyvale, Calif., USA)). The HPAEC/PAD system is calibrated with C13 NMR. The monosaccharides are separated at 35° C. using a flow rate of 0.2 ml/min on a PA-1 analytical column using 100 mM NaOH as eluent with increasing sodium acetate (from 0 to 1M sodium acetate in 30 mins). Each sample is analysed three to five times and an average is calculated. The number of unsubstituted glucose that were directly linked to at least one substituted glucose (A), and the number of unsubstituted glucose that were not directly linked to a substituted glucose (B) are deduced and the DB of the substituted cellulose sample is calculated: DB=B/(A+B).

Viscosity of the Substituted Cellulose.

The substituted cellulose has typically a viscosity at 25° C. when dissolved at 2% by weight in water of at least 100 mPa·s for example a viscosity of from 250 to 5000, or from 500 to 4000, from 1000 to 3000 or from 1500 to 2000 mPa·s. The viscosity of the cellulose may be measured according to the following test method.

Test Method 3: Evaluation of Substituted Cellulose Viscosity

A solution 2% by weight of the cellulose is prepared by dissolving the cellulose in water. The viscosity of the solution is determined using a Haake VT500 viscometer at a shear rate of 5 $s^{-1}$, at 25° C. Each measurement is done for 1 minute with 20 measuring points collected and averaged.

Molecular Weight of the Substituted Cellulose.

Typically, the celluloses of the present invention have a molecular weight in the range of from 10 000 to 10 000 000, for example from 20 000 to 1 000 000, typically from 50 000 to 500 000, or even from 60 000 to 150 000 g/mol.

Degree of Polymerisation (DP) of the Substituted Cellulose.

The substituted cellulose may have a total number of glucose units from 10 to 7000, or of at least 20. Suitable substituted celluloses that are useful in the present invention include celluloses with a degree of polymerization (DP) over 40, preferably from about 50 to about 100,000, more preferably from about 500 to about 50,000.

The total number of glucose units of the substituted cellulose is for example from 10 to 10 000, or 20 to 7500, for example 50 to 5000 and typically 100 to 3000, or from 150 to 2000.

Synthesis

The substituted cellulose used in the present invention may be synthesised by a variety of routes which are well known to those skilled in the art of polymer chemistry. For instance, carboxyalkyl ether-linked celluloses can be made by reacting a cellulose with a suitable haloalkanoic acid, carboxyalkyl ester-linked celluloses can be made by reacting a cellulose with a suitable anhydride, such as succinic anhydride, and sulfoalkyl ether-linked celluloses can be made by reacting a cellulose with a suitable alkenyl sulfonic acid.

The skilled person may obtain substituted cellulose with a higher degree of blockiness for example by choosing the solvent of the reaction, the rate of addition of the reactants, and the alkalinity of the medium during the substituted cellulose synthesis. The synthetic process can be optimised to control the DB, as discussed in V. Stigsson et al., Cellulose, 2006, 13, pp 705-712; N. Olaru et al, Macromolecular Chemistry & Physics, 2001, 202, pp 207-211; J. Koetz et al, Papier (Heidelburg), 1998, 52, pp 704-712; G. Mann et al, Polymer, 1998, 39, pp 3155-3165. Methods for producing carboxymethyl cellulose and hydroxyethyl cellulose having blocky characteristics are also disclosed in WO 2004/048418 (Hercules) and WO 06/088953 (Hercules).

Preferred Substituted Celluloses

The substituted cellulose may be selected from the group consisting of cellulose sulfate, cellulose acetate, sulfoethyl cellulose, cyanoethyl cellulose, methyl cellulose, ethyl cellulose, carboxymethylcellulose, hydroxyethylcellulose, and hydroxypropylcellulose. In particular the substituted cellulose is carboxymethylcellulose.

Non-limiting examples of suitable substituted cellulose derivatives are the sodium or potassium salts of carboxymethyl cellulose, carboxyethyl cellulose, sulfoethyl cellulose, sulfopropyl cellulose, cellulose sulfate, phosphorylated cellulose, carboxymethyl hydroxyethyl cellulose, carboxymethyl hydroxypropyl cellulose, sulfoethyl hydroxyethyl cellulose, sulfoethyl hydroxypropyl cellulose, carboxymethyl methyl hydroxyethyl cellulose, carboxymethyl methyl cellulose, sulfoethyl methyl hydroxyethyl cellulose, sulfoethyl methyl cellulose, carboxymethyl ethyl hydroxyethyl cellulose, carboxymethyl ethyl cellulose, sulfoethyl ethyl hydroxyethyl cellulose, sulfoethyl ethyl cellulose, carboxymethyl methyl hydroxypropyl cellulose, sulfoethyl methyl hydroxypropyl cellulose, carboxymethyl dodecyl cellulose, carboxymethyl dodecoyl cellulose, carboxymethyl cyanoethyl cellulose, and sulfoethyl cyanoethyl cellulose.

The cellulose may be a substituted cellulose substituted by 2 or more different substituents, such as methyl and hydroxyethyl cellulose.

Laundry Adjunct Ingredient

The laundry treatment composition further comprises a laundry adjunct ingredient. This laundry adjunct ingredient is different to the ingredients) required to obtain the substituted cellulose. For example, the laundry adjunct ingredient is not the solvent used to obtain the substituted cellulose by reacting the cellulose backbone and the substituent. The precise nature of these additional adjunct components, and levels of incorporation thereof, will depend on the physical form of the composition and the nature of the operation for which it is to be used. Suitable adjunct materials include, but are not limited to, surfactants, builders, flocculating aid, chelating agents, dye transfer inhibitors, enzymes, enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids, and/or pigments. In addition to the disclosure below, suitable examples of such other adjuncts and levels of use are found in U.S. Pat. Nos. 5,576,282, 6,306,812 B1 and 6,326,348 B1 that are incorporated by reference. Such one or more adjuncts may be present as detailed below:

ENZYME—Preferably, the composition of the invention further comprises an enzyme. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, B-glucanases, arabinosidases, hyaluronidase, chondroitinase, laccase, and amylases, or mixtures thereof. The compositions of the present invention may in particular comprise an enzyme having endo-β-1,4-glucanase activity (E.C.3.4.1.4). Non-limiting examples of suitable endo-β-1,4-glucanase enzymes include Celluclean (Novozymes), Carezyme (Novozymes), Celluzyme (Novozymes), Endolase (Novozymes), KAC (Kao), Puradax HA (Genencor), Puradax EG-L (Genencor), the 20 kDa endo-β-1,4-glucanase endogenous to Melanocarpus Albomyces sold under the Biotouch brand (AB Enzymes), and variants and mixtures of these. Suitable enzymes are listed in WO2007/025549A1, page 4 line 15 to page 11 line 2.

When present in the detergent composition, the aforementioned enzymes may be present at levels from about 0.00001% to about 2%, from about 0.0001% to about 1% or even from about 0.001% to about 0.5% or 0.02% enzyme protein by weight of the composition.

SURFACTANT—The compositions according to the present invention may comprise a surfactant or surfactant system. The compositions may comprise from 0.01% to 90%, for example from 1 to 25, or from 2 to 20, or from 4 to 15, or from 5 to 10%, by weight of a surfactant system. The surfactant may be selected from nonionic surfactants, anionic surfactants, cationic surfactants, ampholytic surfactants, zwitterionic surfactants, semi-polar nonionic surfactants and mixtures thereof.

Anionic Surfactants

Typically, the composition comprises from 1 to 50 wt % or from 2 to 40 wt % anionic surfactant.

Suitable anionic surfactants typically comprise one or more moieties selected from the group consisting of carbonate, phosphate, phosphonate, sulfate, sulfonate, carboxylate and mixtures thereof. The anionic surfactant may be one or mixtures of more than one of $C_{8-18}$ alkyl sulfates and $C_{8-18}$ alkyl sulfonates, linear or branched, optionally condensed with from 1 to 9 moles of $C_{1-4}$ alkylene oxide per mole of $C_{8-18}$ alkyl sulfate and/or $C_{8-18}$ alkyl sulfonate.

Preferred anionic detersive surfactants are selected from the group consisting of: linear or branched, substituted or unsubstituted, $C_{12-18}$ alkyl sulfates; linear or branched, substituted or unsubstituted, $C_{10-13}$ alkylbenzene sulfonates, preferably linear $C_{10-13}$ alkylbenzene sulfonates; and mixtures thereof. Highly preferred are linear $C_{10-13}$ alkylbenzene sulfonates. Highly preferred are linear $C_{10-13}$ alkylbenzene sulfonates that are obtainable, preferably obtained, by sulfonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

Alkoxylated Anionic Surfactants

The composition may comprise an alkoxylated anionic surfactant. When present alkoxylated anionic surfactant will generally be present in amounts form 0.1 wt % to 40 wt %, for example from 1 wt % to 3 wt % based on the detergent composition as a whole.

Typically, the alkoxylated anionic detersive surfactant is a linear or branched, substituted or unsubstituted $C_{12-18}$ alkyl alkoxylated sulfate having an average degree of alkoxylation of from 1 to 30, preferably from 3 to 7.

Suitable alkoxylated anionic detersive surfactants are: Texapan LESTTM by Cognis; Cosmacol AESTM by Sasol; BES151TM by Stephan; Empicol ESC70/UTM; and mixtures thereof.

Non-Ionic Detersive Surfactant

The compositions of the invention may comprise non-ionic surfactant. Where present the non-ionic detersive surfactant(s) is generally present in amounts of from 0.5 to 20 wt %, or from 2 wt % to 4 wt %.

The non-ionic detersive surfactant can be selected from the group consisting of: alkyl polyglucoside and/or an alkyl alkoxylated alcohol; $C_{12}$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. No.

6,153,577, U.S. Pat. No. 6,020,303 and U.S. Pat. No. 6,093,856; alkylcelluloses as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

Cationic Detersive Surfactant

In one aspect of the invention, the detergent compositions are free of cationic surfactant. However, the composition optionally may comprise a cationic detersive surfactant. When present, preferably the composition comprises from 0.1 wt % to 10 wt %, or from 1 wt % to 2 wt % cationic detersive surfactant.

Suitable cationic detersive surfactants are alkyl pyridinium compounds, alkyl quaternary ammonium compounds, alkyl quaternary phosphonium compounds, and alkyl ternary sulfonium compounds. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium surfactants as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. Nos. 4,228,042, 4,239,660, 4,260,529 and 6,022,844; amino surfactants as described in more detail in U.S. Pat. No. 6,221,825 and WO 00/47708, specifically amido propyldimethyl amine; and mixtures thereof.

Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride. Cationic surfactants such as Praepagen HY (tradename Clariant) may be useful and may also be useful as a suds booster.

BUILDER—The detergent composition may comprise one or more builders. When a builder is used, the subject composition will typically comprise from 1% to about 40%, typically from 2 to 25%, or even from about 5% to about 20%, or from 8 to 15% by weight of builder.

The detergent compositions of the present invention comprise from 0 to 20%, in particular less than 15% or 10%, for example less than 5% of zeolite. In particular, the detergent composition comprises from 0 to 20%, in particular less than 15% or 10%, for example less than 5% of aluminosilicate builder(s).

The detergent composition of the present invention may comprise from 0 to 20%, in particular less than 15% or 10%, for example less than 5% of phosphate builder and/or silicate builder and/or zeolite builder.

The detergent compositions of the present invention may comprise from 0 to 20%, in particular less than 15% or 10%, for example less than 5% of sodium carbonate.

Builders include, but are not limited to, the alkali metal, ammonium and alkanolammonium salts of polyphosphates, alkali metal silicates, layered silicates, such as SKS-6 of Clariant®, alkaline earth and alkali metal carbonates, aluminosilicate builders, such as zeolite, and polycarboxylate compounds, ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, fatty acids, the various alkali metal, ammonium and substituted ammonium salts of polyacetic acids such as ethylenediamine tetraacetic acid and nitrilotriacetic acid, as well as polycarboxylates such as mellitic acid, succinic acid, citric acid, oxydisuccinic acid, polymaleic acid, benzene 1,3,5-tricarboxylic acid, carboxymethyloxysuccinic acid, and soluble salts thereof.

The total amount of phosphate builder(s), aluminosilicate builder(s), polycarboxylic acid builder(s), and additional silicate builder(s) in the detergent composition may be comprised from 0 to 25%, or even from 1 to 20%, in particular from 1 to 15%, especially from 2 to 10%, for example from 3 to 5%, by weight.

The composition may further comprise any other supplemental builder(s), chelant(s), or, in general, any material which will remove calcium ions from solution by, for example, sequestration, complexation, precipitation or ion exchange. In particular the composition may comprise materials having at a temperature of 25° C. and at a 0.1M ionic strength a calcium binding capacity of at least 50 mg/g and a calcium binding constant log K $Ca^{2+}$ of at least 3.50.

In the composition of the invention, the total amount of phosphate builder(s), aluminosilicate builder(s), polycarboxylic acid builder(s), additional silicate builder(s), and other material(s) having a calcium binding capacity superior to 50 mg/g and a calcium binding constant higher than 3.50 in the composition may be comprised from 0 to 25%, or even from 1 to 20%, in particular from 1 to 15%, especially from 2 to 10%, for example from 3 to 5%, by weight.

FLOCCULATING AID—The composition may further comprise a flocculating aid. The composition may also be substantially free of flocculating aid. Typically, the flocculating aid is polymeric. Typically the flocculating aid is a polymer comprising monomer units selected from the group consisting of ethylene oxide, acrylamide, acrylic acid and mixtures thereof. Typically the flocculating aid is a polyethyleneoxide. Typically the flocculating aid has a molecular weight of at least 100,000 Da, in particular from 150,000 Da to 5,000,000 Da or even from 200,000 Da to 700,000 Da. Typically, the composition comprises at least 0.3% by weight of the composition of a flocculating aid.

BLEACHING AGENT—The compositions of the present invention may comprise one or more bleaching agents. In general, when a bleaching agent is used, the compositions of the present invention may comprise from about 0.1% to about 50% or even from about 0.1% to about 25% bleaching agent by weight of the subject detergent composition. When present, suitable bleaching agents include bleaching catalysts, suitable bleaching catalysts are listed in WO2008/034674A1, page 46 line 23 to page 49 line 17, photobleaches for example Vitamin K3 and zinc or aluminium phtalocyanine sulfonate; bleach activators such as tetraacetyl ethylene diamine (TAED) and nonanoyloxybenzene sulfonate (NOBS); hydrogen peroxide; pre-formed peracids; sources of hydrogen peroxide such as inorganic perhydrate salts, including alkali metal salts such as sodium salts of perborate (usually mono- or tetra-hydrate), percarbonate, persulfate, perphosphate, persilicate salts and mixtures thereof, optionally coated, suitable coatings including inorganic salts such as alkali metal; and mixtures thereof.

The amounts of hydrogen peroxide source and peracid or bleach activator may be selected such that the molar ratio of available oxygen (from the peroxide source) to peracid is from 1:1 to 35:1, or even 2:1 to 10:1

FLUORESCENT WHITENING AGENT—The composition may contain components that may tint articles being cleaned, such as fluorescent whitening agent. When present, any fluorescent whitening agent suitable for use in a detergent composition may be used in the composition of the present invention. The most commonly used fluorescent whitening agents are those belonging to the classes of diaminostilbenesulfonic acid derivatives, diarylpyrazoline derivatives and bisphenyl-distyryl derivatives.

Typical fluorescent whitening agents are Parawhite KX, supplied by Paramount Minerals and Chemicals, Mumbai, India; Tinopal® DMS and Tinopal® CBS available from Ciba-Geigy AG, Basel, Switzerland. Tinopal® DMS is the disodium salt of 4,4'-bis-(2-morpholino-4 anilino-s-triazin-6-ylamino) stilbene disulfonate. Tinopal® CBS is the disodium salt of 2,2'-bis-(phenyl-styryl)disulfonate.

FABRIC HUEING AGENTS—Fluorescent whitening agents emit at least some visible light. In contrast, fabric hueing agents alter the tint of a surface as they absorb at least a portion of the visible light spectrum. Suitable fabric hueing agents include dyes and dye-clay conjugates, and may also include pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof. Suitable hueing dyes are listed in WO2008/17570A1, page 4 line 15 to page 11 line 18 and WO2008/07318A2, page 9, line 18 to page 21 line 2.

POLYMERIC DISPERSING AGENTS—the compositions of the present invention can contain additional polymeric dispersing agents. Suitable polymeric dispersing agents, include polymeric polycarboxylates, substituted (including quarternized and oxidized) polyamine polymers, and polyethylene glycols, such as: acrylic acid-based polymers having an average molecular of about 2,000 to about 10,000; acrylic/maleic-based copolymers having an average molecular weight of about 2,000 to about 100,000 and a ratio of acrylate to maleate segments of from about 30:1 to about 1:1; maleic/acrylic/vinyl alcohol terpolymers; polyethylene glycol (PEG) having a molecular weight of about 500 to about 100,000, preferably from about 1,000 to about 50,000, more preferably from about 1,500 to about 10,000; and water soluble or dispersible alkoxylated polyalkyleneamine materials. These polymeric dispersing agents, if included, are typically at levels up to about 5%, preferably from about 0.2% to about 2.5%, more preferably from about 0.5% to about 1.5%.

POLYMERIC SOIL RELEASE AGENT—The compositions of the present invention can also contain polymeric soil release agent. polymeric soil release agent, or "SRA", have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures. Preferred SRA's include oligomeric terephthalate esters; sulfonated product of a substantially linear ester oligomer comprised of an oligomeric ester backbone of terephthaloyl and oxyalkyleneoxy repeat units and allyl-derived sulfonated terminal moieties covalently attached to the backbone; nonionic end-capped 1,2-propylene/polyoxyethylene terephthalate polyesters; an oligomer having empirical formula $(CAP)_2$ $(EG/PG)_5$ $(T)_5$ $(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two-end-cap units derived from sodium 2-(2-hydroxyethoxy)-ethanesulfonate; oligomeric esters comprising: (1) a backbone comprising (a) at least one unit selected from the group consisting of dihydroxy sulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred are esters of the empirical formula:

$$((CAP)_a(EG/PG)_b(DEG)_cPEG)_d(T)_e(SIP)_f(SEG)_g(B)_h)$$

wherein CAP, EG/PG, PEG, T and SIP are as defined hereinabove, DEG represents di(oxyethylene)oxy units, SEG represents units derived from the sulfoethyl ether of glycerin and related moiety units, B represents branching units which are at least trifunctional whereby ester linkages are formed resulting in a branched oligomer backbone, a is from about 1 to about 12, b is from about 0.5 to about 25, c is from 0 to about 12, d is from 0 to about 10, b+c+d totals from about 0.5 to about 25, e is from about 1.5 to about 25, f is from 0 to about 12; e+f totals from about 1.5 to about 25, g is from about 0.05 to about 12; h is from about 0.01 to about 10, and a, b, c, d, e, f, g, and h represent the average number of moles of the corresponding units per mole of the ester; and the ester has a molecular weight ranging from about 500 to about 5,000; and; cellulosic derivatives such as the hydroxyether cellulosic polymers available as METHOCEL® from Dow; the $C_1$-$C_4$ alkyl celluloses and $C_4$ hydroxyalkyl celluloses, see U.S. Pat. No. 4,000,093, issued Dec. 28, 1976 to Nicol et al., and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100® and METOLOSE SM200®, which are the trade names of methyl cellulose ethers manufactured by Shinetsu Kagaku Kogyo KK.

ENZYME STABILIZERS—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability.

CATALYTIC METAL COMPLEXES—The compositions of the invention may comprise catalytic metal complexes. When present, one type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. No. 5,597,936; U.S. Pat. No. 5,595,967. Such cobalt catalysts are readily prepared by known procedures, such as taught for example in U.S. Pat. No. 5,597,936, and U.S. Pat. No. 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

SOFTENING SYSTEM—the compositions of the invention may comprise a softening agent and optionally also with flocculants and enzymes; optionally for softening through the wash.

FABRIC SOFTENING BOOSTING COMPONENT—Typically, the composition additionally comprises a charged polymeric fabric-softening boosting component. When the composition comprises clay and silicone particles, preferably, the charged polymeric fabric-softening boosting component is contacted to the clay and silicone in step (ii) of the process for obtaining clay and silicone particles (see above). The intimate mixing of the charged polymeric fabric-softening boosting component with the clay and silicone further improves the fabric-softening performance of the resultant composition.

COLORANT—the compositions of the invention may comprise a colorant, preferably a dye or a pigment. Particularly, preferred dyes are those which are destroyed by oxidation during a laundry wash cycle. To ensure that the dye does not decompose during storage it is preferable for the dye to be stable at temperatures up to 40° C. The stability of the dye in the composition can be increased by ensuring that the water content of the composition is as low as possible. If possible, the dyes or pigments should not bind to or react with textile fibres. If the colorant does react with textile fibres, the colour imparted to the textiles should be destroyed by reaction with the oxidants present in laundry wash liquor. This is to avoid coloration of the textiles, especially over several washes. Particularly, preferred dyes include but are not limited to Basacid® Green 970 from BASF and Monastral blue from Albion.

Laundry Treatment Composition

The laundry treatment composition is preferably a laundry detergent composition or a fabric care composition.

The laundry treatment composition may comprise a solvent. Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

The laundry treatment composition is for example in particulate form, preferably in free-flowing particulate form, although the composition may be in any liquid or solid form. The composition in solid form can be in the form of an agglomerate, granule, flake, extrudate, bar, tablet or any combination thereof. The solid composition can be made by methods such as dry-mixing, agglomerating, compaction, spray drying, pan-granulation, spheronization or any combination thereof. The solid composition preferably has a bulk density of from 300 g/l to 1,500 g/l, preferably from 500 g/l to 1,000 g/l.

The substituted cellulose may be added as a dry added component or via laundry particles formed by spray drying or extrusion.

The laundry treatment composition may also be in the form of a liquid, gel, paste, dispersion, preferably a colloidal dispersion or any combination thereof. Liquid compositions typically have a viscosity of from 500 mPa·s to 3,000 mPa·s, when measured at a shear rate of 20 $s^{-1}$ at ambient conditions (20° C. and 1 atmosphere), and typically have a density of from 800 g/l to 1300 g/l. If the composition is in the form of a dispersion, then it will typically have a volume average particle size of from 1 micrometer to 5,000 micrometers, preferably from 1 micrometer to 50 micrometers. The particles that form the dispersion are usually the clay and, if present, the silicone. Typically, a Coulter Multisizer is used to measure the volume average particle size of a dispersion.

The laundry treatment composition may be in unit dose form, including not only tablets, but also unit dose pouches wherein the composition is at least partially enclosed, preferably completely enclosed, by a film such as a polyvinyl alcohol film.

The laundry treatment composition may also be in the form of an insoluble substrate, for example a non-woven sheet, impregnated with detergent actives.

The laundry treatment composition may be capable of cleaning and/or softening fabric during a laundering process. Typically, the laundry treatment composition is formulated for use in an automatic washing machine, although it can also be formulated for hand-washing use.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

The following examples are given by way of illustration only and therefore should not be construed to limit the scope of the invention.

EXAMPLES

Example 1

Preparation of Compositions A, B, 1 and 2

The following abbreviation have been used:

LAS: Sodium linear alkylbenzene sulfonate

STPP: Sodium tripolyphosphate

Other detergent ingredients include materials such as protease, optical brightener, water and perfume.

Celulase enzyme: Celluclean®, supplied by Novozymes, Bagsvaerd, Denmark. Enzyme level expressed as active protein concentration in the wash liquor.

LB CMC: carboxymethyl cellulose, Finnfix® BDA supplied by CPKelco, Arnhem, Netherlands.

HB CMC: carboxymethyl cellulose, Highly blocky CMC supplied by CPKelco, Arnhem, Netherlands.

The viscosity, degree of substitution and degree of blockiness of these two CMC are given in the table below:

| | Viscosity as 2% solution (mPa · s) | Degree of substitution (DS) | Degree of blockiness (DB) |
|---|---|---|---|
| LB CMC | 77 | 0.53 | 0.33 |
| HB CMC | 1740 | 0.76 | 0.50 |

A base composition was prepared:

| Ingredient | Weight % |
|---|---|
| LAS | 16.00 |
| STPP | 12.00 |
| Sodium carbonate | 20.00 |
| Sodium silicate (2.0R) | 6.00 |
| Sodium sulfate | 45.64 |
| Other detergent ingredients | 0.36 |

The following formulations were prepared:

| Example | |
|---|---|
| Comparative composition A | Base composition |
| Comparative composition B | Base composition + 1.0 wt % LB CMC |
| Composition 1 | Base composition + 0.3 wt % HB CMC |
| Composition 2 | Base composition + 0.3 wt % HB CMC + 0.05 ppm cellulase enzyme |

Example 2

Antiredeposition Performance of Compositions A, B, 1 and 2

This method was used to compare the relative performance of lower blockiness CMC (LB CMC) with a highly blocky CMC(HB CMC) in accordance with the invention.

In the following test, test wash solutions were prepared, using water of 12 gpg hardness, containing 2 g/l (based on the weight of the base composition) of the composition A, B, C, 1 or 2. The test fabrics were 5 cm×5 cm squares of white knitted cotton, supplied by Warwick Equest, Stanley, County Durham, UK. Eight replicates used for each test formulation. The same fabric type was used to make up the ballast load. Tergotometer pots were 1 l pot size, supplied by Copley Scientific, Nottingham, UK. Ballast were knitted cotton added to maintain 30:1 water:cloth ratio. Soil was 100 ppm carbon black, supplied by Warwick Equest, Stanley, County Durham, UK.

Tergotometer pots containing a test wash solution (0.8 L) plus test fabrics, ballast and soil at 25° C. were agitated at 200 rpm for 20 minutes. After the wash, the test fabrics and ballast were separated. The process was repeated using washed test fabrics for 4 cycles. Clean ballast is used for each wash cycle. The test fabrics were then rinsed in water (12 gpg hardness) in the tergotometer pots with 200 rpm agitation for 5 minutes, followed by drying at ambient room temperature for at least 12 hours.

The reflectance values of the test fabrics were measured (460 nm, D65/10°) before washing and after 4 cycles. The following table shows mean reflectance values after the 4 cycles, expressed as change compared to untreated fabrics as well as the benefice in the reflectance change when compared with the base composition.

| Example | Number of replicates | Mean Reflectance (460 nm) change after 4 cycles | Benefice in the Reflectance change |
|---|---|---|---|
| Comparative composition A | 8 | −40.15 | Ref |
| Comparative composition B | 8 | −35.57 | +4.58 |
| Composition 1 | 8 | −33.12 | +7.03 |
| Composition 2 | 8 | −28.84 | +11.31 |

This method quantifies the anti-deposition properties of the test formulations. Reflectance values decreases with deposition of carbon black soil: the smaller the drop in reflectance, the better the anti-deposition properties of the detergent formulation.

The results show that in the absence of cellulase enzyme, HB-CMC, a substituted cellulose according to the invention achieves significantly improved anti-redeposition performance compared to a much higher level of LB CMC (Composition 1 vs Comparative composition B). It can also be seen that the presence of cellulase leads to an enhancement in the anti-redeposition performance of HB-CMC (composition 2 vs composition 1).

Examples 3-8

The following are granular detergent compositions produced in accordance with the invention suitable for laundering fabrics by handwashing or top-loading washing machines.

| | 3 (wt %) | 4 (wt %) | 5 (wt %) | 6 (wt %) | 7 (wt %) | 8 (wt %) |
|---|---|---|---|---|---|---|
| Linear alkylbenzenesulfonate | 20 | 12 | 20 | 10 | 12 | 13 |
| Other surfactants | 1.6 | 1.2 | 1.9 | 3.2 | 0.5 | 1.2 |
| Phosphate builder(s) | 5 | 25 | 4 | 3 | 2 | |
| Zeolite | | 1 | | 1 | 4 | 1 |
| Silicate | 4 | 5 | 2 | 3 | 3 | 5 |
| Sodium Carbonate | 9 | 20 | 10 | 17 | 5 | 23 |
| Polyacrylate (MW 4500) | 1 | 0.6 | 1 | 1 | 1.5 | 1 |

-continued

| | 3 (wt %) | 4 (wt %) | 5 (wt %) | 6 (wt %) | 7 (wt %) | 8 (wt %) |
|---|---|---|---|---|---|---|
| HB-CMC[1] | 1 | 0.3 | 0.3 | 0.1 | 1.1 | 0.9 |
| Cellulase[2] | 0.1 | | 0.1 | | 0.3 | 0.1 |
| Other enzymes powders | 0.23 | 0.17 | 0.5 | 0.2 | 0.2 | 0.6 |
| Fluorescent Brightener(s) | 0.16 | 0.06 | 0.16 | 0.18 | 0.16 | 0.16 |
| Diethylenetriamine pentaacetic acid or Ethylene diamine tetraacetic acid | 0.6 | | 0.6 | 0.25 | 0.6 | 0.6 |
| $MgSO_4$ | 1 | 1 | 1 | 0.5 | 1 | 1 |
| Bleach(es) and Bleach activator(s) | 6.88 | | 6.12 | 2.09 | 1.17 | 4.66 |
| Sulfate/Moisture/perfume | Balance to 100% | Balance to 100% | Balance to 100% | Balance to 100% | Balance to 100% | Balance to 100% |

Examples 9-14

The following are granular detergent compositions produced in accordance with the invention suitable for laundering fabrics by front-loading washing machine.

| | 9 (wt %) | 10 (wt %) | 11 (wt %) | 12 (wt %) | 13 (wt %) | 14 (wt %) |
|---|---|---|---|---|---|---|
| Linear alkylbenzenesulfonate | 8 | 7.1 | 7 | 6.5 | 7.5 | 7.5 |
| Other surfactants | 2.95 | 5.74 | 4.18 | 6.18 | 4 | 4 |
| Layered silicate | 2.0 | | 2.0 | | | |
| Zeolite | 7 | | 7 | | 2 | 2 |
| Citric Acid | 3 | 5 | 3 | 4 | 2.5 | 3 |
| Sodium Carbonate | 15 | 20 | 14 | 20 | 23 | 23 |
| Silicate | 0.08 | | 0.11 | | | |
| Soil release agent | 0.75 | 0.72 | 0.71 | 0.72 | | |
| Acrylic Acid/Maleic Acid Copolymer | 1.1 | 3.7 | 1.0 | 3.7 | 2.6 | 3.8 |
| HB-CMC[1] | 0.15 | 1.4 | 0.2 | 1.4 | 1 | 0.5 |
| Cellulase[2] | 0.2 | 0.15 | 0.2 | 0.3 | 0.15 | 0.15 |
| Other enzyme powders | 0.65 | 0.75 | 0.7 | 0.27 | 0.47 | 0.48 |
| Bleach(es) and bleach activator(s) | 16.6 | 17.2 | 16.6 | 17.2 | 18.2 | 15.4 |
| Sulfate/Water & Miscellaneous | Balance to 100% | Balance to 100% | Balance to 100% | Balance to 100% | Balance to 100% | Balance to 100% |

In the exemplified compositions 3-14, the concentrations of the components are in weight percentage and the abbreviated component identifications have the following meanings.

LAS: Linear alkylbenzenesulfonate having an average aliphatic carbon chain length $C_{11}$-$C_{12}$, HB-CMC[1]: carboxymethyl cellulose having viscosity (as 2% solution) of 1740 mPa·s, degree of substitution 0.76 and degree of blockiness 0.50, supplied by the Noviant division of CPKelco, Arnhem, Netherlands.

Cellulase[2]: Celluclean® (15.6 mg active/g) supplied by Novozymes, Bagsvaerd, Denmark.

What is claimed is:

1. A composition being a laundry treatment composition or component thereof, comprising:

a substituted cellulose having a degree of substitution, DS, between 0.55 to 0.80, a degree of blockiness, DB, of at least 0.35 and a DS+DB, of from 1.05 to 2.00 and a laundry adjunct ingredient.

2. A composition according to claim 1, wherein the substituted cellulose has a 2% by weight viscosity in water of at least 100 mPa·s.

3. A composition according to claim 1, wherein the substituted cellulose comprises at least one glucose unit of its backbone which is substituted with a substituent selected from the group consisting of branched, linear or cyclic, substituted or not substituted, saturated or unsaturated alkyl, amine (primary, secondary, tertiary), ammonium salt, amide, urethane, alcohol, carboxylic acid, tosylate, sulfonate, sulfate, nitrate, phosphate, silicone and mixtures thereof.

4. A composition according to claim 1, wherein the substituted cellulose is carboxymethylcellulose.

5. A composition according to claim 1, wherein the composition further comprise an enzyme having endo-β-1,4-glucanase activity.

6. A composition according to any one of the preceding claims, comprising at least 1% of substituted cellulose.

7. A composition according to claim 1, comprising from 0 to 20% of phosphate builder and/or silicate builder and/or zeolite builder.

8. A method of cleaning and/or softening fabric, comprising the step of treating the fabric with a laundry composition comprising a substituted cellulose having a degree of substitution, DS, of between 0.55 and 0.80 and a degree of blockiness, DB, of at least 0.35 and a DS+DB, of from 1.05 to 2.00.

* * * * *